US009486044B1

(12) United States Patent
Dai

(10) Patent No.: US 9,486,044 B1
(45) Date of Patent: Nov. 8, 2016

(54) REVERSE FOLDING UMBRELLA

(71) Applicant: Jenhao Dai, Taipei (TW)

(72) Inventor: Jenhao Dai, Taipei (TW)

(73) Assignee: Jenny Fan, Bradley, IL (US)

( * ) Notice: Subject to any disclaimer, the term of this patent is extended or adjusted under 35 U.S.C. 154(b) by 0 days.

(21) Appl. No.: 14/941,680

(22) Filed: Nov. 16, 2015

(51) Int. Cl.

| | |
|---|---|
| ***A45B 19/00*** | (2006.01) |
| ***A45B 25/22*** | (2006.01) |
| ***A45B 25/02*** | (2006.01) |
| ***A45B 21/00*** | (2006.01) |

(52) U.S. Cl.
CPC ..... *A45B 19/00* (2013.01); *A45B 21/00* (2013.01); *A45B 25/02* (2013.01); *A45B 25/22* (2013.01); *A45B 2019/008* (2013.01)

(58) Field of Classification Search
CPC ..... A45B 19/00; A45B 21/00; A45B 25/22; A45B 25/02; A45B 2019/008
See application file for complete search history.

(56) References Cited

U.S. PATENT DOCUMENTS

| | | | | | |
|---|---|---|---|---|---|
| 1,397,794 | A * | 11/1921 | Chase | A45B 25/22 | 135/27 |
| 1,555,568 | A * | 9/1925 | Gustafson | A45B 19/10 | 135/25.3 |
| 1,969,171 | A * | 8/1934 | Evans | A45B 25/02 | 135/22 |
| 3,779,260 | A * | 12/1973 | Garay | A45B 19/00 | 135/25.33 |
| 3,853,135 | A * | 12/1974 | Schafer | A45B 19/10 | 135/25.3 |
| 7,484,518 | B2 * | 2/2009 | Brader | A45B 23/00 | 135/25.33 |
| 8,240,322 | B2 * | 8/2012 | Chang | A45B 19/00 | 135/27 |
| 2004/0211451 | A1 * | 10/2004 | Goh | A45B 25/20 | 135/31 |
| 2008/0006313 | A1 * | 1/2008 | Wang | A45B 19/00 | 135/31 |
| 2012/0160283 | A1 * | 6/2012 | Lee | A45B 19/10 | 135/20.3 |
| 2012/0266928 | A1 * | 10/2012 | Lee | A45B 25/02 | 135/20.3 |

* cited by examiner

*Primary Examiner* — Noah Chandler Hawk

(57) ABSTRACT

A reverse folding umbrella includes a cane body and a umbrella body; the cane body including a shaft and a handle; the umbrella body including a hollow tube, outer and inner fabric; the hollow tube having a grip disposed in one end thereof, and a top notch disposed in opposite end thereof; the top notch having a plurality of upper ribs connected around a peripheral edge thereof; one end of the upper ribs connected with reverted ribs; the reverted ribs connected with lower ribs; the lower ribs connected around a peripheral edge of a runner; the reverse folding umbrella that has the function of rain or sun shelter and walking cane.

12 Claims, 6 Drawing Sheets

REVERSE FOLDING UMBRELLA

FIELD OF THE INVENTION

The present invention is relates to an improved reverse folding umbrella.

BACKGROUND OF THE INVENTION

The patent reference M508941 published on Sep. 21, 2015 discloses a "reversible umbrella" which is only used for keeping rain out or sun shelter, the prior the cane body is not strong enough to be a walking can to support a user's body weight.

In view of this, the technical problem to be solved by the utility model is to overcome defects of the prior art and develop a reverse folding umbrella that can be used for sun or rain shelter and walking cane.

SUMMARY OF INVENTION

The present invention is to provide a reverse folding umbrella that has the function of rain or sun shelter and walking cane.

The remarkable advantages of the utility model are that a reverse folding umbrella, comprising: a cane body (1) and an umbrella body (2) sleeved with the cane body (1);

wherein the cane body (1) comprises a shaft (11) and a handle (12) mounted on one end of the shaft (11); wherein the umbrella body (2) comprises a hollow tube (21), an outer fabric (22), and an inner fabric (23); wherein the hollow tube (21) comprises a grip (211) disposed at one end thereof, a top notch (212) disposed at the opposite end thereof, a plurality of upper ribs (213) pivotally connected around a peripheral edge of the top notch (212), a plurality of inverted ribs (214) connected to one end of the upper ribs (213), a plurality of lower ribs (215) pivotally connected to one end of the inverted ribs (214), a runner (216) around a peripheral edge thereof pivotally connected to one end of the lower ribs (215), a middle notch (217) arranged at a top of the runner (216), and a plurality of stretchers (218) with one end thereof connected around a peripheral edge of the middle notch (217) and the opposite end thereof connected to the upper ribs (213); wherein the end of the upper ribs (213) are simultaneously connected to a support rod (219); wherein the support rod (219) with one end thereof is disposed at the lower rib (215) and has a spring element (2191) arranged on a middle section thereof; wherein the spring element (2191) with one end thereof is connected with the upper rib (213); wherein the outer fabric (22) is mounted above the upper rib (213) and lower rib (214), and the inner fabric is mounted under the lower rib (215); wherein the handle (12) has a first connecting part (121) extended therebelow; wherein the grip (211) has a second connecting part (3) arranged at a top inner wall thereof, the second connecting part (3) configured to connecting with the first connecting part (121), whereby connecting the handle (12) and the grip (211);

wherein the top notch (212) has at least one fastener (4) and the hollow tube (21) has at least one fixing hole (5) provided to the fastener (4) clipped therein, whereby fixing the top notch (212) and hollow tube (21).

Wherein the first connecting part (121) having an external thread section and the second connecting part (3) having an internal thread section are in threaded connection therebetween.

Wherein the first connecting part (121) has a magnetic part and the second connecting part (3) has a non-magnetic element, but can be magnetic, which are in magnetic connection therebetween.

Wherein the first and second connecting part (121, 3) respectively having a magnetic part are in magnetic connection therebetween.

Wherein the hollow tube (21) comprises a ferrule (6) disposed in one end thereof.

Wherein the hollow tube (21) and the top notch (212) are joined together by glue.

Wherein the top notch (212) comprises an elastic piece (7) with thread extended upward therefrom; wherein the elastic piece (7) is provided for threaded connection with a screw sleeve (8).

Wherein the one end of the upper rib (213) and the inverted rib (214) have a joint part (9) connected therebetween.

Wherein the middle notch (217) is smaller than the runner (216) in diameter.

Wherein the inverted rib (214) having one end thereof comprises a link structure (10); wherein the link structure (10) comprises a first fixing part (101) having one end thereof connected with the end of the inverted rib (214) and disposed in a peripheral edge of the outer fabric (22); and a second fixing part (102) having one end thereof connected with the opposite end of the first fixing part (101) and disposed in a peripheral edge of the inner fabric (23); wherein the first and second fixing part (101, 102) are configured to fix the outer and inner fabric (22, 23) in the inverted rib (214).

Wherein the first fixing part (101) is further comprises a first through hole (1011) on one side thereof; wherein the first through hole (1011) is configured to connect with the outer fabric (22).

Wherein the second fixing part (102) is further comprises a second through hole (1021) on one side thereof; wherein the second through hole (1021) is configured to connect with the inner fabric (22).

To sum up, the present invention has following advantages:

1. The function of the present invention is used in both reverse folding umbrella and walking cane, the user can separate the walking cane from the reverse folding umbrella and simultaneously use the walking cane and the reverse folding umbrella with two hands, thereby improving the practicality and convenience.
2. The present invention has the first connecting part disposed under the handle, which is used to cooperate with the second connecting part of the grip, thereby ensuring connection of the cane body and the umbrella body.
3. The present invention has at least one fastener disposed inside inner wall of the top notch to cooperate with the fixing hole, thereby ensuring stability between the top notch and the hollow tube, moreover, the fastener is designed in a convex point that would not affect movement of the hollow tube, thereby improving flexibility over length of the cane and the umbrella body in manufacturing.
4. The umbrella body don't have top or bottom spring button, when the reverse folding umbrella is in use or not in use, the user only need to move the runner to the desired position without pressing the spring button to fix it, thereby simplifying the action in operation of the reverse folding umbrella.

5. Instead of adding ribs, the present invention utilizes the link structure to fix the inner and outer fabric in the inverted rib, thereby improving wind resistance for the structure of the reverse folding umbrella and saving on production cost.

DETAILED DESCRIPTION OF THE PREFERRED EMBODIMENTS

Figure 1:
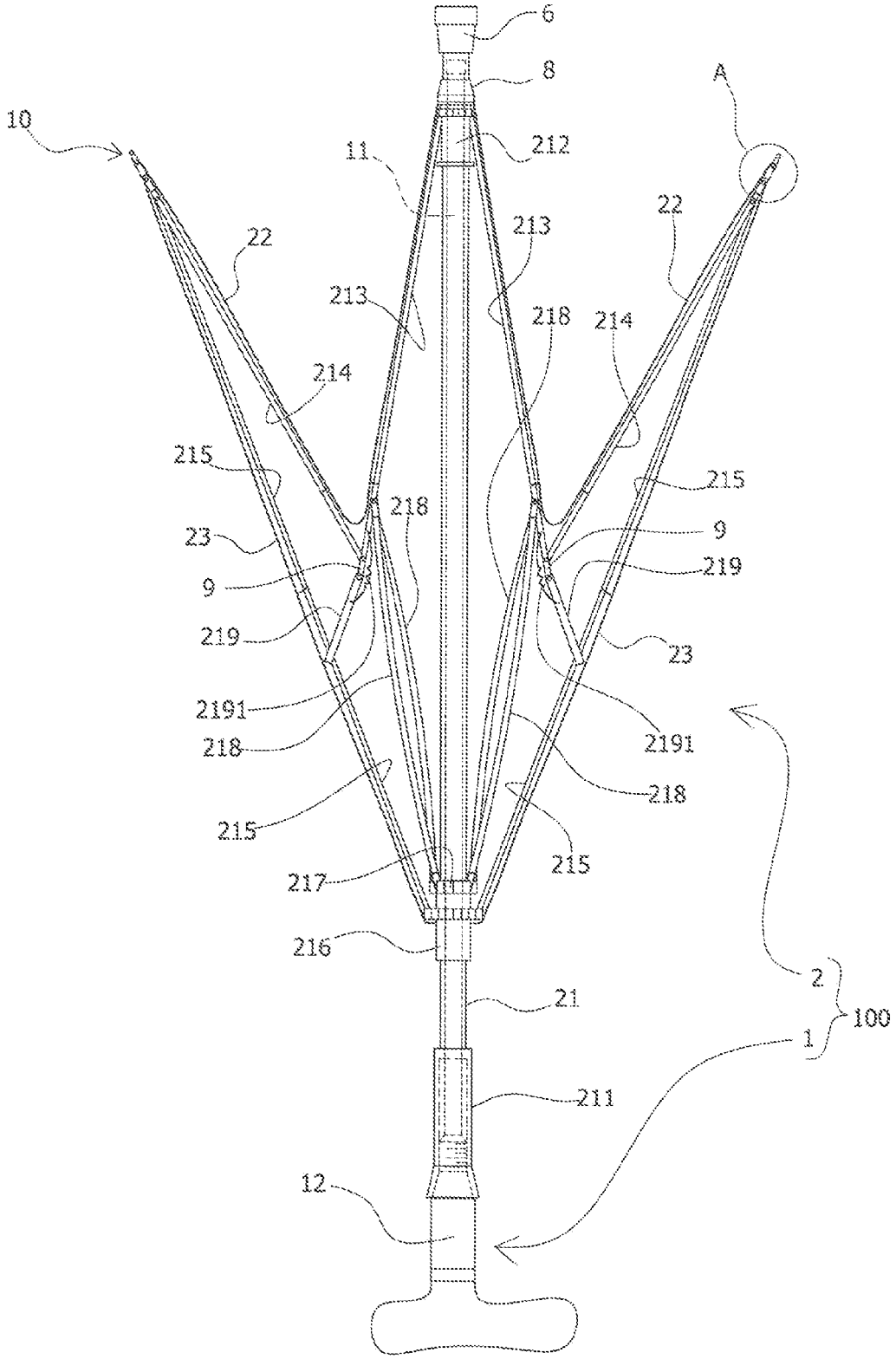
FIG. 1 is a schematic view of the present invention.

Referring to FIG. 1-4, the figures disclose a reverse folding umbrella, comprising: a cane body (1) and a umbrella body (2) sleeved with the cane body (1); wherein the cane body (1) comprises a shaft (11) and a handle (12) mounted on one end of the shaft (11);

wherein the umbrella body (2) comprises a hollow tube (21), an outer fabric (22), and an inner fabric (23); wherein the hollow tube (21) comprises a grip (211) disposed at one end thereof, a top notch (212) disposed at the opposite end thereof, a plurality of upper ribs (213) pivotally connected around a peripheral edge of the top notch (212), a plurality of inverted ribs (214) connected to one end of the upper ribs (213), a plurality of lower ribs (215) pivotally connected to one end of the inverted ribs (214), a runner (216) around a peripheral edge thereof pivotally connected to one end of the lower ribs (215), a middle notch (217) arranged at a top of the runner (216), and a plurality of stretchers (218) with one end thereof connected around a peripheral edge of the middle notch (217) and the opposite end thereof connected to the upper ribs (213); wherein the end of the upper ribs (213) are simultaneously connected to a support rod (219); wherein the support rod (219) with one end thereof is disposed at the lower rib (215) and has a spring element (2191) arranged on a middle section thereof; wherein the spring element (2191) with one end thereof is connected with the upper rib (213); wherein the outer fabric (22) is mounted above the upper rib (213) and lower rib (214), and the inner fabric is mounted under the lower rib (215); wherein the handle (12) has a first connecting part (121) extended therebelow; wherein the grip (211) has a second connecting part (3) arranged at a top inner wall thereof, the second connecting part (3) configured to connecting with the first connecting part (121), whereby connecting the handle (12) and the grip (211);

wherein the top notch (212) has at least one fastener (4) and the hollow tube (21) has at least one fixing hole (5) provided to the fastener (4) clipped therein, whereby fixing the top notch (212) and hollow tube (21).

According to the description above, the cane body (1) can be separated from the umbrella body (2), so the user can hold the reverse folding umbrella with one hand and hold the cane with the other hand at the same time.

Figure 5:
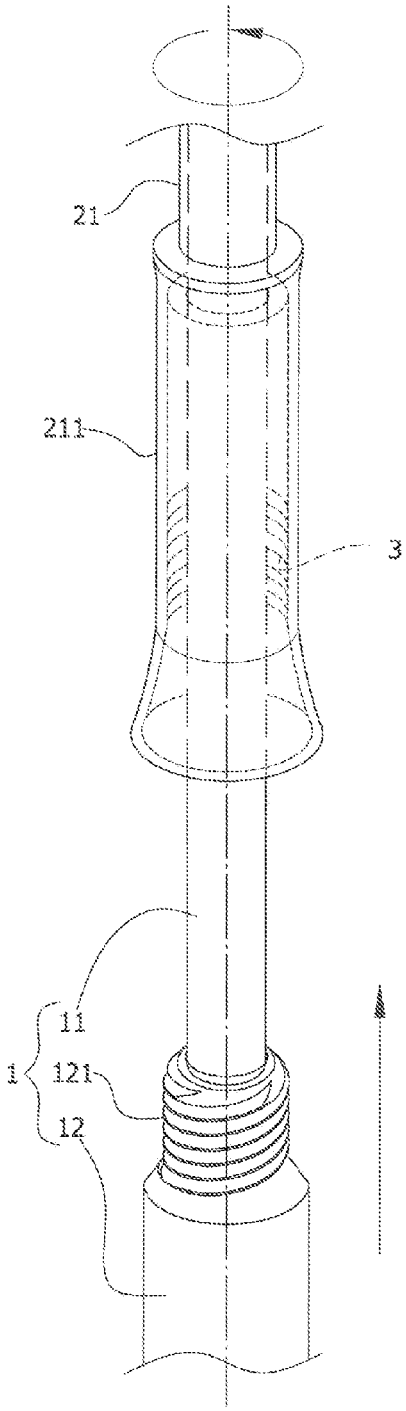
FIG. 5 is a schematic view showing the handle separated from the grip.

Referring to FIG. 5, the first connecting part (121) disposed under the handle (12) is joined with the second connecting part (3) of the grip (211), thereby ensuring connection of the cane body and the umbrella body.

Wherein the first connecting part (121) having an external thread section and the second connecting part (3) having an internal thread section are in threaded connection therebetween, thereby firmly connecting the handle (12) and the grip (211) together.

Wherein the first connecting part (121) has a magnetic part and the second connecting part (3) has a non-magnetic element, but can be magnetic, which are in magnetic connection therebetween; wherein the first and second connecting part (121, 3) respectively having a magnetic part are in magnetic connection therebetween. By the magnetic connection, the handle (12) can be easily connected with or rapidly removed from the grip (211).

Figure 6:
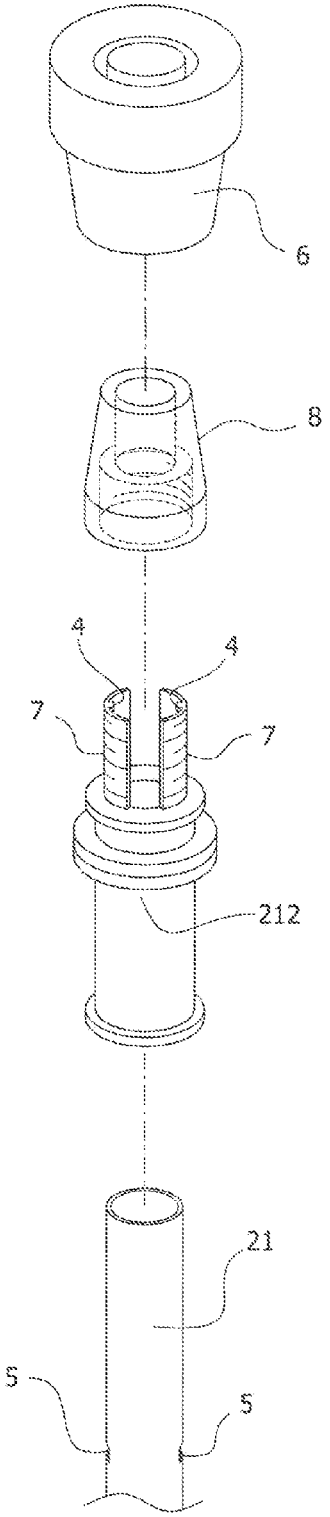
FIG. 6 is a part exploded view.

Referring to FIG. 6, the top notch (212) has at least one fastener (4) disposed inside inner wall of the top notch (4) to cooperate with the fixing hole (5), thereby ensuring stability between the top notch (4) and the hollow tube (21), moreover, the fastener is designed in a convex point that would not affect movement of the hollow tube (21), the length of the cane body (1) can be made in accordance with the one of the umbrella body (2), thereby improving flexibility over length of the cane body (1) and the umbrella body (2) in manufacturing.

Figure 3:
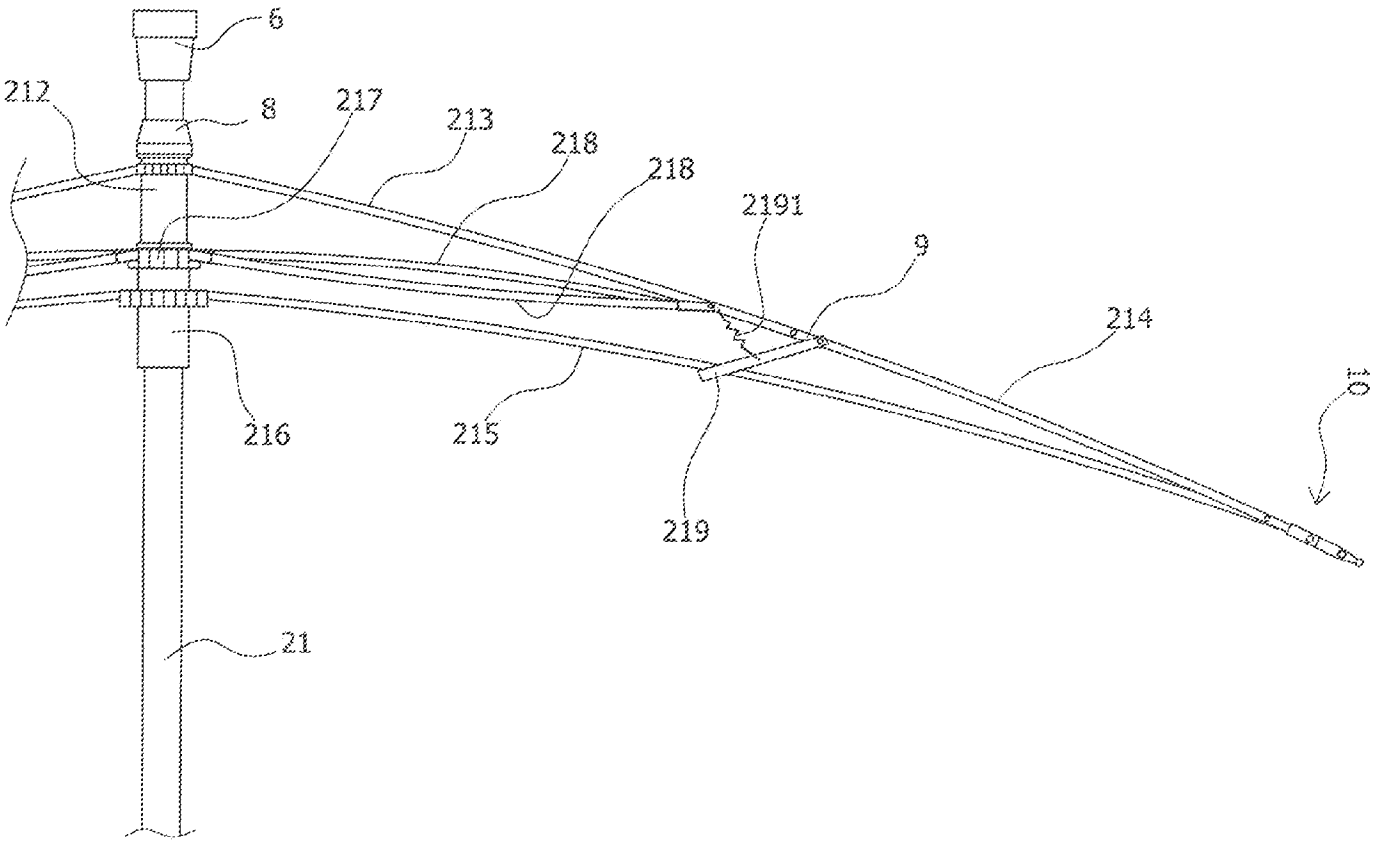
FIG. 3 is a schematic view when the reverse folding umbrella is opening.
Figure 4:
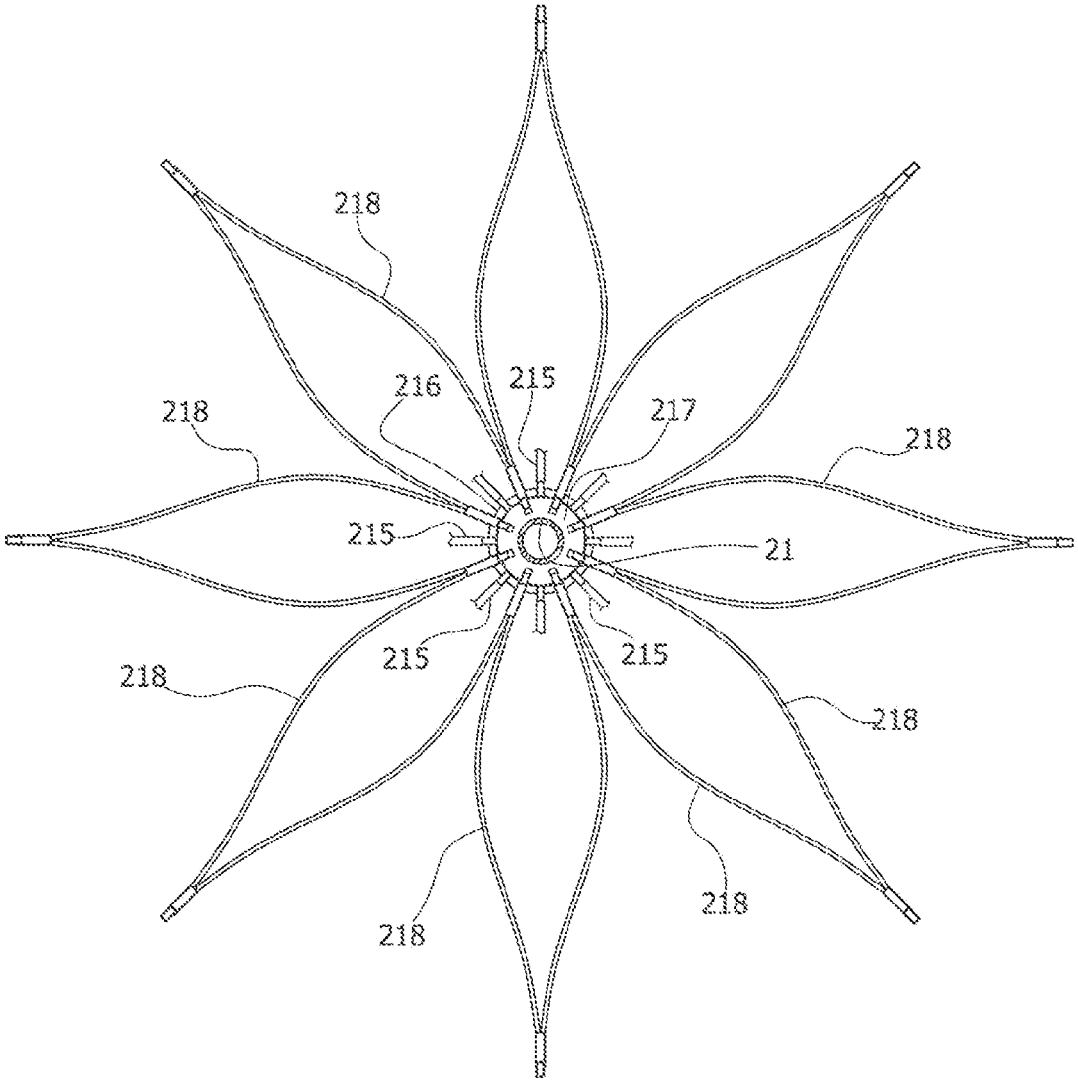
FIG. 4 is a schematic view of the second embodiment of the present invention.

Referring to FIGS. 1, 3 and 4, when the reverse folding umbrella is in use, the user only needs to push the runner (216) up to expand the stretchers (218) and spread out the outer and inner fabric (22, 23); when the reverse folding umbrella is not in use, the user pull the runner (216) down to collapse the stretchers (218) and fold the outer and inner fabric (22, 23); the umbrella body don't have top or bottom spring button, when the reverse folding umbrella is in use or not in use, the user only need to move the runner to the desired position without pressing the spring button to fix it, thereby simplifying the action in operation of the reverse folding umbrella.

Referring to FIG. 6, wherein the hollow tube (21) comprises a ferrule (6) disposed in one end thereof; the ferrule (6) help the cane body (1) to increase friction on the ground and absorb shock, so as to improve the user's safety.

Wherein the hollow tube (21) and the top notch (212) are joined together by glue. The hollow tube (21) can be tightly fixed with top notch (212) through the application of glue.

Wherein the top notch (212) comprises an elastic piece (7) with thread extended upward therefrom; wherein the elastic piece (7) is provided for threaded connection with a screw sleeve (8); wherein the screw sleeve (8) covers the end of the umbrella body (2) to completely avoid leaking rain and lossing threaded connection.

Figure 2:
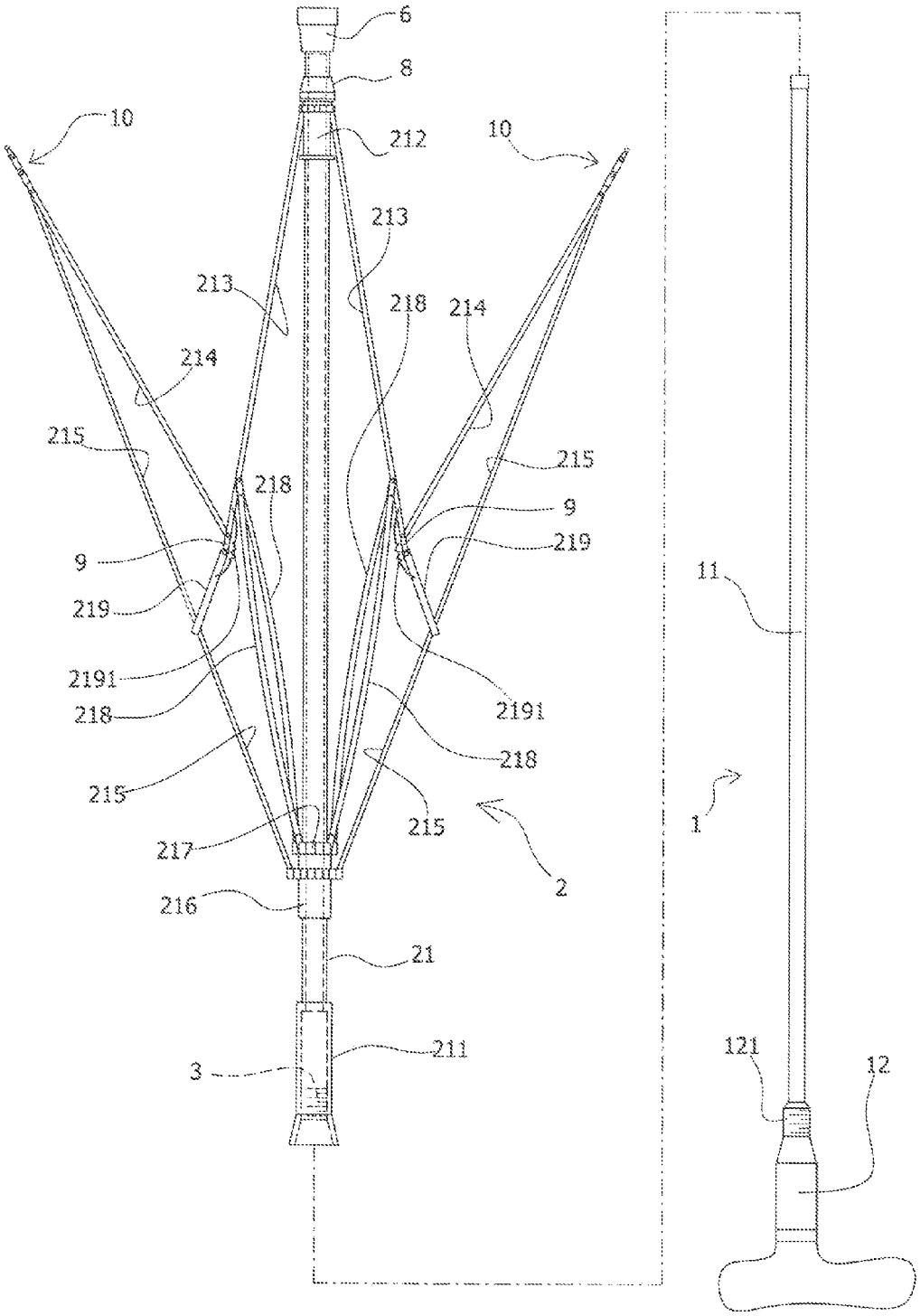
FIG. 2 is an exploded view of the present invention.

Referring to FIG. 1-3, wherein the one end of the upper rib (213) and the inverted rib (214) have a joint part (9) connected therebetween; the joint part (9) drives the inverted rib (214) up and down movement, thereby achieving smoothly operating the reverse folding umbrella.

Wherein the middle notch (217) is smaller than the runner (216) in diameter; through which the stretchers (218) is completely collapsed when the reverse folding umbrella is folded.

Figure 7:
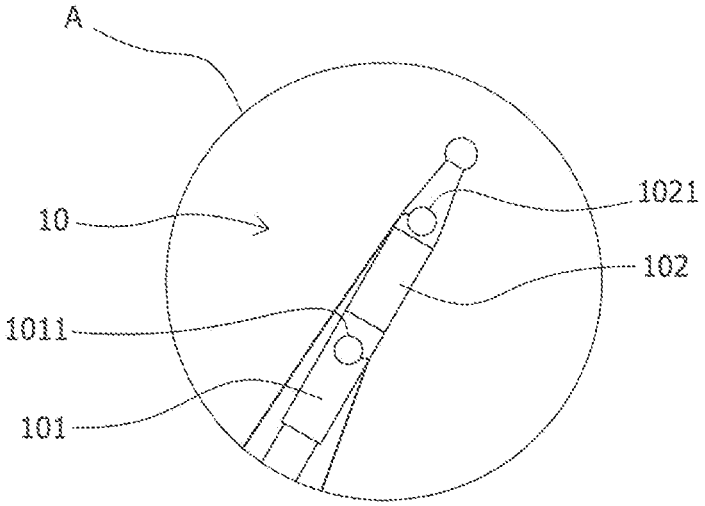
FIG. 7 is an enlarged view of part A of FIG. 1.
Figure 8:
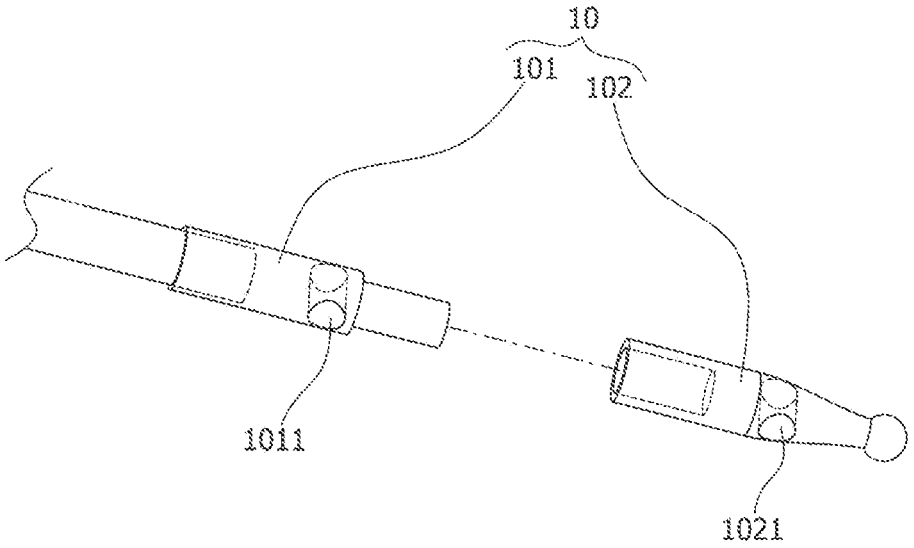
FIG. 8 is an exploded view showing link structure of the present invention.

Referring to FIGS. 1, 7, and 8, wherein the inverted rib (214) having one end thereof comprises a link structure (10); wherein the link structure (10) comprises a first fixing part (101) having one end thereof connected with the end of the inverted rib (214) and disposed in a peripheral edge of the outer fabric (22); and a second fixing part (102) having one end thereof connected with the opposite end of the first fixing part (101) and disposed in a peripheral edge of the inner fabric (23); wherein the first and second fixing part (101, 102) are configured to fix the outer and inner fabric (22, 23) in the inverted rib (214).

Wherein the first fixing part (101) is further comprises a first through hole (1011) on one side thereof; wherein the first through hole (1011) is configured to connect with the outer fabric (22).

Wherein the first fixing part (101) is further comprises a first through hole (1011) on one side thereof; wherein the first through hole (1011) is configured to connect with the outer fabric (22); instead of adding ribs, the present invention utilizes the link structure (10) to fix the inner and outer fabric (22, 23) in the inverted rib, thereby improving wind resistance for the structure of the reverse folding umbrella and saving on production cost.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A reverse folding umbrella, comprising:

a cane body (1) and a umbrella body (2) sleeved with the cane body (1);

wherein the cane body (1) comprises a shaft (11) and a handle (12) mounted on one end of the shaft (11);

wherein the umbrella body (2) comprises a hollow tube (21), an outer fabric (22), and an inner fabric (23);

wherein the hollow tube (21) comprises a grip (211) disposed at one end thereof, a top notch (212) disposed at the opposite end thereof, a plurality of upper ribs (213) pivotally connected around a peripheral edge of the top notch (212), a plurality of inverted ribs (214) connected to one end of the upper ribs (213), a plurality of lower ribs (215) pivotally connected to one end of the inverted ribs (214), a runner (216) around a peripheral edge thereof pivotally connected to one end of the lower ribs (215), a middle notch (217) arranged at a top of the runner (216), and a plurality of stretchers (218) with one end thereof connected around a peripheral edge of the middle notch (217) and the opposite end thereof connected to the upper ribs (213); wherein the end of the upper ribs (213) are simultaneously connected to a support rod (219); wherein the support rod (219) with one end thereof is disposed at the lower rib (215) and has a spring element (2191) arranged on a middle section thereof; wherein the spring element (2191) with one end thereof is connected with the upper rib (213); wherein the outer fabric (22) is mounted above the upper rib (213) and lower rib (214), and the inner fabric is mounted under the lower rib (215);

wherein the handle (12) has a first connecting part (121) extended therebelow; wherein the grip (211) has a second connecting part (3) arranged at a top inner wall thereof, the second connecting part (3) configured to connecting with the first connecting part (121), whereby connecting the handle (12) and the grip (211);

wherein the top notch (212) has at least one fastener (4) and the hollow tube (21) has at least one fixing hole (5) provided to the fastener (4) clipped therein, whereby fixing the top notch (212) and hollow tube (21).

2. The reverse folding umbrella according to claim 1, wherein the first connecting part (121) having an external thread section and the second connecting part (3) having an internal thread section are in threaded connection therebetween.

3. The reverse folding umbrella according to claim 1, wherein the first connecting part (121) has a magnetic part and the second connecting part (3) has a non-magnetic element, but can be magnetic, which are in magnetic connection therebetween.

4. The reverse folding umbrella according to claim 1, wherein the first and second connecting part (121, 3) respectively having a magnetic part are in magnetic connection therebetween.

5. The reverse folding umbrella according to claim 1, wherein the hollow tube (21) comprises a ferrule (6) disposed in one end thereof.

6. The reverse folding umbrella according to claim 1, wherein the hollow tube (21) and the top notch (212) are joined together by glue.

7. The reverse folding umbrella according to claim 1, wherein the top notch (212) comprises an elastic piece (7) with thread extended upward therefrom; wherein the elastic piece (7) is provided for threaded connection with a screw sleeve (8).

8. The reverse folding umbrella according to claim 1, wherein the one end of the upper rib (213) and the inverted rib (214) have a joint part (9) connected therebetween.

9. The reverse folding umbrella according to claim 1, wherein the middle notch (217) is smaller than the runner (216) in diameter.

10. The reverse folding umbrella according to claim 1, wherein the inverted rib (214) having one end thereof comprises a link structure (10); wherein the link structure (10) comprises a first fixing part (101) having one end thereof connected with the end of the inverted rib (214) and disposed in a peripheral edge of the outer fabric (22); and a second fixing part (102) having one end thereof connected with the opposite end of the first fixing part (101) and disposed in a peripheral edge of the inner fabric (23); wherein the first and second fixing part (101, 102) are configured to fix the outer and inner fabric (22, 23) in the inverted rib (214).

11. The reverse folding umbrella according to claim 10, wherein the first fixing part (101) is further comprises a first through hole (1011) on one side thereof; wherein the first through hole (1011) is configured to connect with the outer fabric (22).

12. The reverse folding umbrella according to claim 10, wherein the second fixing part (102) is further comprises a second through hole (1021) on one side thereof; wherein the second through hole (1021) is configured to connect with the inner fabric (22).

* * * * *